United States Patent [19]

Green et al.

[11] Patent Number: 4,682,568

[45] Date of Patent: Jul. 28, 1987

[54] REFRACTORY SHIELD FOR SUPERHEATER TUBES

[75] Inventors: Kenneth E. Green, Auburn; Donald K. Johnson; Roger W. Woodruff, both of Holden, all of Mass.

[73] Assignee: Norton Company, Worcester, Mass.

[21] Appl. No.: 871,004

[22] Filed: Jun. 5, 1986

[51] Int. Cl.[4] ..... F22B 15/00; F22B 25/00; F22B 37/10

[52] U.S. Cl. ..... 122/235 C; 122/511; 122/DIG. 13; 165/180; 432/234

[58] Field of Search ..... 122/511, DIG. 13, 235 C; 138/149; 432/234; 165/133, 180

[56] References Cited

U.S. PATENT DOCUMENTS

| | | | |
|---|---|---|---|
| 1,871,508 | 8/1932 | Gardner | 122/DIG. 13 |
| 3,914,100 | 10/1975 | Guskea | 432/324 |
| 3,969,153 | 7/1976 | Suzuki et al. | 122/DIG. 13 |
| 4,054,174 | 10/1977 | Haller | 122/DIG. 13 |
| 4,071,311 | 1/1978 | Errington | 432/234 |
| 4,124,068 | 11/1978 | Thompson | 165/134 R |
| 4,501,232 | 2/1985 | Gordbegli et al. | 122/235 C |

*Primary Examiner*—Edward G. Favors
*Attorney, Agent, or Firm*—Walter Fred

[57] ABSTRACT

A superheater tube shield of refractory material comprises a pair of elongated half shields of identical interchangeable interlocking size and shape, each half shield having a semi-circular sidewall portion extending between and to diametrically opposite tongue and groove side wall portions which are assembled together about the tubes by axially inserting elongaged tongues into the elongated grooves. Refractory cement may be applied to attach the half sheilds to the tubes.

15 Claims, 6 Drawing Figures

REFRACTORY SHIELD FOR SUPERHEATER TUBES

TECHNICAL DISCLOSURE

A refractory shield comprising a pair of refractory half shields of identical interchangeable interlocking size and shape including interlocking tongue and grooves, extends the life of superheater incinerator tubes by protecting them from chemical attack by the high temperatures, corrosive, errosive and abrasive products of combustion during incineration of refuse and generation of energy therefrom.

BACKGROUND OF THE INVENTION

1. Field of Invention

The invention relates to refractory components of specific interchangeable and interlocking size and shape for protecting boiler super heated tubes from corrosive, errosive and abrasive action by the products of combustion during incinerator of trash and garbage and generation of energy therefrom.

2. Description of the Prior Art

The prior art discloses many different types of fiberous refractory materials applied to and insulating hot air ducts, hot water and steam pipes from heat loss. Boiler, hot air, steam and water tubes have also been made of various high temperature alloys, stainless steel and coated with various material to prevent errosion, corrosion and abrasion and chemical attack thereof by the products of combustion. However, the above prior art methods and material have not been entirely satisfactory and short lived in apparatus such as incinerators in which municipal refuse, trash and garbage are simultaneously burned to heat and produce super heated steam or other fluids in the tubes for driving turbine driven generators and producing energy therewith.

The instant invention provides protection and shields the tubes from direct attack by the harmful products of combustion without loss of heat transfer to the tubes with easily applied and without additional fasteners, heat conducting refractory shields of simple interchanged and interlocking size and shape.

SUMMARY OF THE INVENTION

A superheater tube refractory shield comprises one or more but at least one pair of interchangeable and interlocked half sections or shields of identical size and semi-circular shape made of refractory material such as nitride bonded silicon carbide, alumina, zirconia, magnesia, chromia and mixtures thereof. Each of the half sections have elongated tongue and groove side portions and assembled together about a longitudinal section of a boiler tube by means of a refractory mortar cement and an interlocking axial engagement of the tongue and groove portions of the pair of half sections of the shield. One or more of the interlocked shields may be required and assembled about each of the longitudinal tubes in order to shield the entire axial length of each of the heated tubes of a super heater, boiler, incinerator or heat exchanger.

DESCRIPTION OF THE PREFERRED EMBODIMENTS(S)

Figure 1:
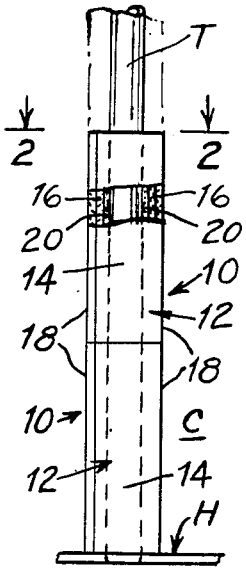
FIG. 1 is a partial view in elevation of a section of a superheater and one of its tubes surrounded and protected by the refractory shield of the invention.
Figure 2:
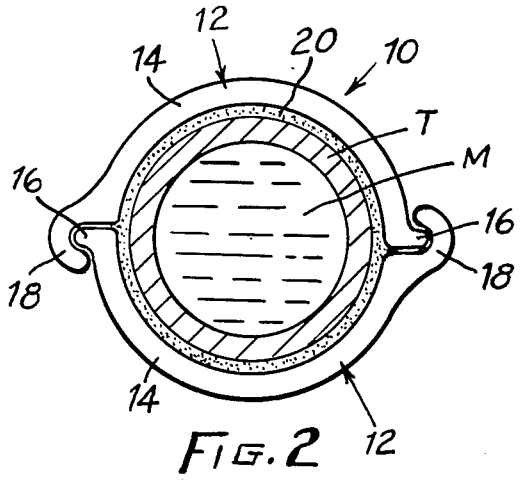
FIG. 2 is an enlarged cross sectional view of the refractory shield taken on line 2—2 of FIG. 1 and showing the half sections thereof of identical size and shape assembled about a section of the superheater tube.
Figure 3:
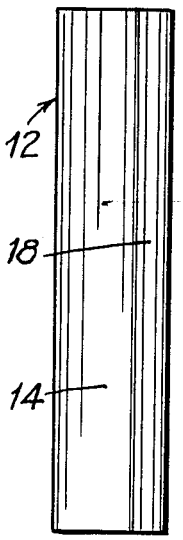
FIG. 3 is a side view in elevation of the grooved side portion of one of the half sections of the refractory shield.
Figure 4:
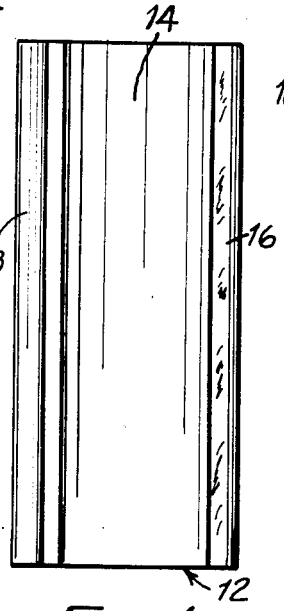
FIG. 4 is an inside view in elevation of the half section shown in FIG. 3.
Figure 5:
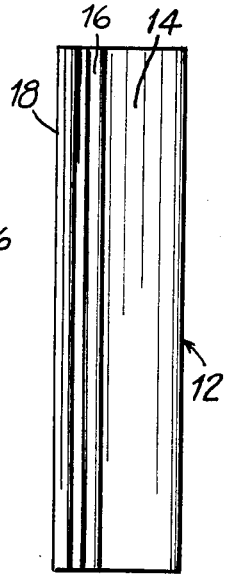
FIG. 5 is a side view in elevation of the tongue side portion of the half section shown in FIG. 4.
Figure 6:
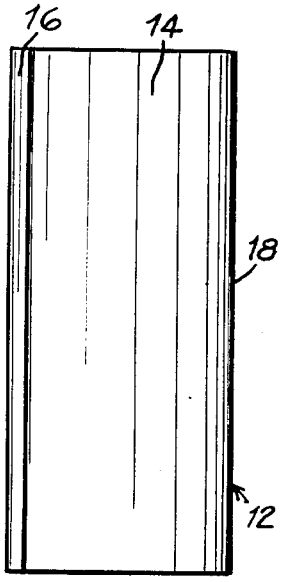
FIG. 6 is an outer side view in elevation of the half section of the shield shown in FIG. 5.

In FIG. 1 there is shown a portion of one of many elongated superheater tubes T that extend longitudinally or vertically in the combustion chamber C of a superheater H such as a high temperature municipal trash and garbage incinerator. In addition to disposing of the trash and garbage the incinerator is utilized to burn and produce therefrom a source of energy such as steam to drive a turbine driven electrical generator or to merely heat the fluid used for other purposes.

During operation, the incinerator burns the trash and garbage at high temperature and produces corrosive, errosive and abrasive products of combustion which heat and attack the metallic tubes T containing a fluid medium M such as gases, air, steam, liquids or water super heated to produce steam or hot gases at sufficient temperature and pressure to drive a turbine and generator.

To prevent direct attack of the tubes by the product of combustion and yet allow the tubes to be super heated, the instant invention provides one or more heat conducting high temperature refractory shields 10 assembled about, surrounding and protecting one or more sections of each longitudinal tube T containing the fluid medium M.

Each of the refractory shields 10 comprises a pair of elongated half shields or sections 12 each of identical interchangeable, interlocking, size and generally semi-circular shape made of a suitable refractory composition containing a refractory material selected from a group consisting of silicon carbide, alumina, zirconia, magnesia, chromia and mixtures thereof.

Each refractory half shield 12 comprises an elongated sidewall portion 14 of predetermined axial length between opposite ends, thickness and arcuate or semi-circular shape extending circumferentially about the tube T to and between an elongated tongue shape side portion 16 and a diametrically opposite elongated mating grooved side wall portion 18. The tongue and grooved side portions 16 and 18 are situated about 180° apart and each project radially outwardly and lie in the same diametral plane passing through longitudinal axis of each half shield 12 and the shield 10.

The grooved side portion 18 of each half shield 12 has an outer wall about a radially extending elongated internal groove which is substantially U-shaped, adapted to mate with and receive the substantially U-shape elongated tongue portion 16 of the other one of the pair of half shields 12. However, the tongue and groove can be C-shape or any other mating shape adapted to lock together without the need of additional fasteners.

As assembled the pair of half shields 12 are situated and rotated 180° to one another so that the radially projecting tongue and groove side wall portions 16 and 18 of each of the half shields 12 are interlocked together.

During assembly, each half shield 12 need not be but is preferably adhered to the outer surface of the tube T by a layer of plastic mortar cement 20 containing substantially the same refractory material as the shield.

The plastic mortar cement is applied to either the tube T or the inner surfaces of the half shields 12. One of the half shields 12 is then attached to the outer surface of the tube T and the other is then rotated 180° thereto to align the tongue 16 of one with the groove 18 of the other and slid axially together. The process is repeated until the exposed outer surface of each of the tubes of the superheater are covered. After a period of a few hours the mortar cement will harden somewhat to space and hold the shield 10 in place and upon firing of the superheater it will become a harder bonded refractory material and a better conductor of heat to the tubes T.

Refractory shields 10 made of nitride bonded silicon carbide material made and sold by Norton Company, Worcester, Mass. under its registered trademark "CRYSTON" have been tested for a few months at an average temperature of 1800° F. and show no signs of errosion or wear. Thus, the shields are expected to last from 3 to 6 years and to protect and extend the life of incinerator tubes at least three times their average life of 1 to 1½ years for an unprotected tube exposed to the same products of combustion. Furthermore, replacement of the refractory shields every 3 years is found to be less costly and to take less time than replacing the tubes requiring a greater amount of downtime and loss of energy generating capacity and loss of revenue therefrom.

A typical shield 10 for a tube about 2½" (6.4 cm) outside diameter comprises pair of identical half shields 12 each about 18" (45.8 cm) long between opposite flat ends of the semi-circular sidewall about ¼" (6.5 mm) thick, with an inside radius of 1⅜" (3.5 cm) and a loose mating tongue and groove approximating ¼" (6.5 mm) wide and about 7/16" (11 mm) in radial length or depth. The overall maximum radial dimension of the assembled shield 10 being about 4 3/16" (11 cm) over the grooved side portion and about 3⅞" (9.8 cm) overall maximum radial dimension over the tongue and groove portion of each half section 12.

Each half section 12 may be molded to shape by various conventionally known techniques and fired in a kiln at known temperatures and periods of time.

The superheater tube shields of the invention are preferably nitride bonded silicon carbide refractory material made of the following mixture of ingredients:

30% by weight of 30–90 mesh green silicon carbide

17% by weight of 100 mesh and finer green silicon carbide

35% by weight of 3 microns green silicon carbide

18% by weight of 200 and finer mesh silicon metal powder

The above mixture of ingredients was mixed with approximately 12% by weight of water and 0.75% by weight of sodium silicate deflocculant solution until it attains a viscosity suitable for slip casting in a porous mold of the desired shape. A mold is filled with the mixture or slip, dried and removed from the mold. The green slip cast shape is then further dried and fired at 1450° C. in a kiln with a nitrogen atmosphere until cured. The process of slip casting the above mixture is with slight variations substantially the same as that taught in U.S. Pat. No. 2,964,823 incorporated hereby by reference.

A preferred refractory mortar cement composition for attaching the half shields 12 comprises a mixture of 85% by weight of 10 mesh size and finer size particles of green silicon carbide and 15% by weight of calcium aluminate mixed together and with 10–15% water to form a plastic mortar. Upon firing during operation of the incinerator the mortar becomes a bonded silicon carbide layer between the shield 10 and the superheater tubes.

We claim:

1. A refractory shield for protecting superheater tubes against attack by the products of combustion comprising:

a pair of elongated molded and fired refractory half shields of predetermined identical interchangeable interlocking size and shape adapted when one of the half shields is rotated 180° and extended longitudinally relative to the other half shields to be slid axially together and interlocked together solely thereby without additional fastening means, surround and shield the superheater tube, each half shield having:

an elongated refractory sidewall portion of predetermined axial length and thickness between opposite ends thereof extending circumferentially between and to diametrically opposite retractory tongue and grooved side wall portions of predetermined axially engageable interlocking shape; an elongated tongue of predetermined shape, width and radial length projecting radially outwardly from the tongue sidewall portion; and an elongated internal groove projecting radially outward in the grooved side wall portion and of predetermined interlocking shape, sufficient width and radial depth to accept an elongated tongue of the other one of the pair of half shields assembled and locked together against relative rotation solely by axially inserting the tongues into the grooves.

2. A refractory shield according to claim 1 wherein the tongue and groove of each half shield are located diametrically opposite one another and lie in the same plane.

3. A refractory shield according to claim 1 wherein each of the half shields has a semi-circular sidewall portion.

4. A refractory shield according to claim 1 further comprising:

a layer of refractory cement on the inner surfaces of each of the half shield for attachment to a superheater tube and containing a refractory material selected from the group consisting of silicon carbide, alumina, zirconia, magnesia, chromia and mixtures thereof.

5. A refractory shield according to claim 1 wherein each of the half shields is made of a refractory composition containing a refractory material selected from a group consisting of silicon carbide, alumina, zirconia, magnesia, chromia, and mixtures thereof.

6. A refractory shield according to claim 4 wherein the layer of refractory cement contains calcium aluminate bond material.

7. A refractory shield according to claim 1 wherein the half shields are made of nitride bonded silicon carbide.

8. A refractory shielded superheater tube protected against the products of combustion comprising:

a tube of predetermined cross sectional shape, size, wall thickness and longitudinal length with an internal passage therethrough for a fluid medium;

at least one refractory shield surrounding, protecting and extending the life of the tube including a pair of elongated molded and fired refractory half shields of predetermined identical interchangeable interlocking size and shape rotated 180° relative to each other, slid axially together and interlocked together solely thereby without additional fastening means and extending around the outer surface of the superheater tube and each half shield having an elongated refractory sidewall portion of predetermined axial length and thickness between ends thereof extending circumferentially between and to diametrically opposite refractory tongue and grooved side wall portions of predetermined axially engageable interlocking shape, an elongated tongue of predetermined shape, width and radial length projecting radially outwardly from the tongue sidewall portion, and an elongated internal groove projecting radially outwardly in the grooved side wall portion and of predetermined interlocking shape, sufficient width and radial depth to accept an elongated tongue of the other one of the pair of half shields assembled and locked together against relative rotation solely by axially inserting the tongues in the grooves.

9. A refractory shielded superheater tube according to claim 8 wherein the tongue and groove of each half shield are located diametrically opposite one another and lie in the same plane.

10. A refractory shielded superheater tube according to claim 8 wherein each of the half shields has a semicircular sidewall portion.

11. A refractory shielded superheater tube according to claim 9 further comprising:

a layer of refractory material between the superheater tube and each of the refractory half shields.

12. A refractory shielded superheater tube according to claim 8 wherein each of the refractory half shields are made of a refractory composition containing a refractory material selected from a group consisting of silicon carbide, alumina, zirconia, magnesia, chromia and mixtures thereof.

13. A refractory shielded superheater tube according to claim 11 wherein the layer of refractory material contains a refractory material selected from a group consisting of silicon carbide, alumina, zirconia, magnesia, chromia and mixtures thereof.

14. A refractory shielded superheater tube according to claim 13 wherein the layer of refractory material is a calcium aluminate bonded layer of refractory material.

15. A refractory shielded superheater tube according to claim 8 wherein the half shields are made of nitride bonded silicon carbide.

* * * * *